United States Patent [19]

Beuret et al.

[11] Patent Number: 4,858,893

[45] Date of Patent: Aug. 22, 1989

[54] BELL FURNANCE AND HARDENING VAT ARRANGEMENT

[75] Inventors: Pierre Beuret; Pascal Beuret, both of Porrentruy, Switzerland

[73] Assignee: Pierre Beuret, Porrentruy, Switzerland

[21] Appl. No.: 200,727

[22] Filed: May 31, 1988

[30] Foreign Application Priority Data

Jun. 5, 1987 [CH] Switzerland ..... 2145/87

[51] Int. Cl.[4] ..... C21D 9/00

[52] U.S. Cl. ..... 266/249; 266/274; 266/287; 266/253

[58] Field of Search ..... 266/259, 274, 253, 287, 266/256, 262, 263, 130, 132, 207; 432/254.2

[56] References Cited

U.S. PATENT DOCUMENTS

| | | | |
|---|---|---|---|
| 1,481,338 | 1/1924 | Baldwin | 266/132 |
| 1,838,015 | 6/1927 | Forster et al. | 432/241 |
| 1,876,960 | 1/1929 | Kenworthy | 266/253 |
| 3,381,947 | 5/1968 | Beggs | 266/4 |
| 4,415,145 | 11/1983 | Herdieckerhoff | 266/253 |

FOREIGN PATENT DOCUMENTS

| | | |
|---|---|---|
| 167102 | 11/1950 | Austria . |
| 0023546 | 2/1981 | European Pat. Off. . |
| 1942801 | 7/1980 | Fed. Rep. of Germany . |
| 3525635 | 1/1987 | Fed. Rep. of Germany . |
| 1521505 | 4/1968 | France . |
| 95877 | 11/1971 | France . |
| 478918 | 11/1969 | Switzerland . |
| 899793 | 6/1962 | United Kingdom . |

*Primary Examiner*—Christopher W. Brody
*Attorney, Agent, or Firm*—Oliff & Berridge

[57] ABSTRACT

A bell furnace (2) and hardening vat (3) arrangement comprises charge (4) supporting means (14, resp. 29, 32, 33) connected to the bell and extending toward the center of the bell. It comprises means (18, 18', resp. 28) for imparting solely to the bell either a vertical and rotary movement or only solely a vertical movement, while the vat (3) is under the furnace (1), in such a way that the bell can be brought against the top plane of the vat, the bell/vat unit forming a tight enclosure at the time of hardening. A lift can introduce into the bell, and the means (18, 18;, resp. 31, 34, 37) co-operate at the same time in the release of the charge and in the placing of the latter on the supporting means (14).

12 Claims, 7 Drawing Sheets

BELL FURNANCE AND HARDENING VAT ARRANGEMENT

BACKGROUND AND SUMMARY OF THE INVENTION

The present invention has as its subject a bell furnace and hardening vat arrangement, the furnace and the vat being placed at different levels, one of these elements or each of them being movable horizontally relative to one another, the arrangement including means for supporting a charge composed of parts contained in a cage, these means being integral with the bell and projecting from the sidewall and on the inside of the latter, the arrangement further comprising a lift capable of entering the bell.

The problems encountered at the time of the hardening operations in heat treatment installations including the apparatus of the type just of referred to are essentially four in number: first, that of oxidation of the parts when they enter into contact with the oxygen of the air after having been brought to high temperature in the furnace and, if the case arises, of oxidation of the fluid used as a hardening bath, in the second place, in the cases where the vat, situated below the furnace, contains a gas protecting the hardening bath, that of the rapid dispersion of this gas at the time of the manipulation consisting in transferring the charge from the furnace into the bath; in the third place, that, connected moreover with the two problems previously referred to, of air pollution; finally, that of flexibility and correlatively of autonomy, as well as of the space requirement of the installation in general and of the rapidity of execution of the manipulations connected with the various treatment operations. The fact that all the problems must be solved jointly, without the solution provided to one of them hampering that of the others, further increases the difficulty.

The bell furnace/hardening vat arrangements utilized in the known heat treatment installations illustrate this difficulty. Thus, the patent DE 19 42 801, though it supplies a first solution to the problem of flexiblity by providing means permitting the bell furnace to be brought above the vat, leaves the problem of the oxidation of the parts untouched. In the same way, though the bell has means for supporting the charge, the lift raising the latter in the furnace must effect a rotation of 45° to set down or inversely to release the charge from these means. Moreover, the use of a block and tackle remains necessary for certain manipulations. Patent GB No. 899,793, on the other hand, proposes a solution to the problem of oxidation, the furnace and the vat forming a quasi monolithic structure. But the arrangement presents two major drawbacks which are, on the one hand, the totally static and non-versatile characters of the installation and, on the other hand, the bulk thereof, the overall height of the installation exceeding three times the height of a charge, the latter being conveyed laterally, in a passage situated between the furnace and the vat. Finally, the duration of the handling still remains too long in the two cited prior disclosures.

Patents FR-1,521,505 and DE-3,525,635 teach the possibility of a vertical movement of the joined furnace/bell unit with a view to obtaining imperviousness either at the time of the heating operation (French patent) or at the time of the hardening operation (German patent). The devices described present a series of major drawbacks; there shall be retained as such, as concerns FR-1,521,505, the absence of imperviousness, the immersion of the plug, the considerable energy losses, the pollution of the charge and of the air; as concerns DE 3,525,635, the absence of a mooring system, the permanent support of the charge by the lift of the vat, and the total absence of autonomy of the furnace.

The present invention has as an object to provide an arrangement of the kind mentioned at the beginning which contributes, especially with the invention which is the subject of a parallel application of the same applicant, a joint solution to the problems enumerated, and to avoid the drawbacks set forth.

To this end, the arrangement answering the general concept of the preamble of claim 1 is characterized in that means are provided for subjecting solely the bell to a relative vertical movement in relation to the furnace, the furnace remaining fixed, while the vat is under the furnace, so that the mere bottom rim of the bell is brought against the top peripheral portion of the vat, the bell and the vat then forming a tight enclosure.

The arrangement further comprises a lift capable of entering into the bell, the furnace being equipped with means for release of the charge, capable of displacing said support means between an active position where they extend under the perimeter of the charge and a withdrawn position where they release the perimeter of the charge and permit its vertical displacement by means of the lift.

BRIEF DESCRIPTION OF THE DRAWING

Embodiments of the arrangement according to the invention will be described below, by way of example, referring to the appended drawings, in which.

DETAILED DESCRIPTION OF THE PREFERRED EMBODIMENTS

A general presentation of the installation will first be made with the aid of FIGS. 1 and 2 before describing the arrangement proper in detail.

Figure 1:
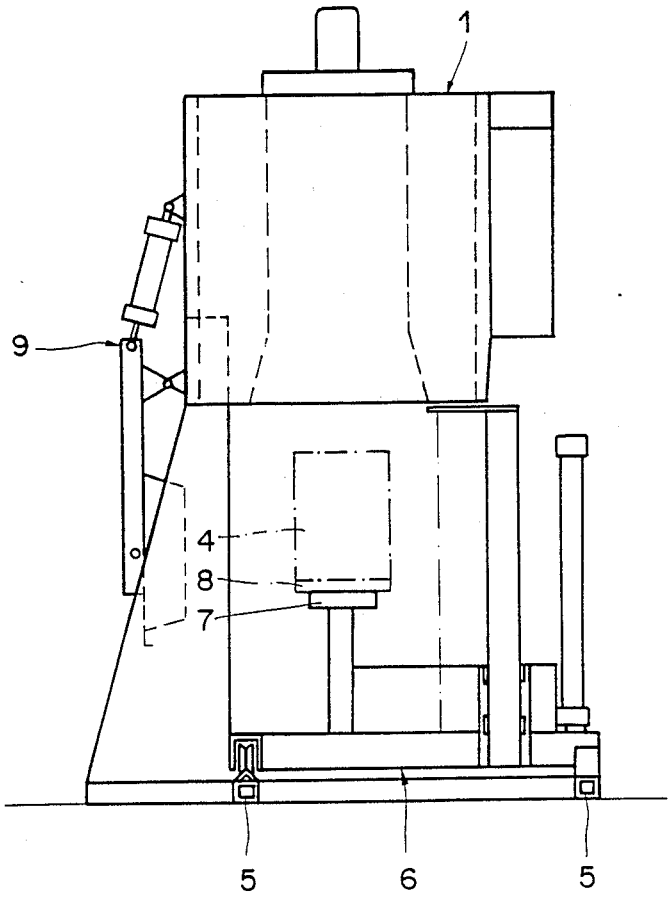
FIGS. 1 and 2 represent diagrammatic views of the profile of the installation.

In FIG. 1, the furnace 1 is seen, under the opening of which is the charge 4 composed of parts contained in a cage and intended to be subjected to a heat treatment. The charge 4 is on a lift platform 7 forming part of a materials handling car 6 movable horizontally on a conveyor track 5 formed of two rails. When the The closure device 9 is open, when charge can be conveyed to the inside of the furnace.

Figure 2:
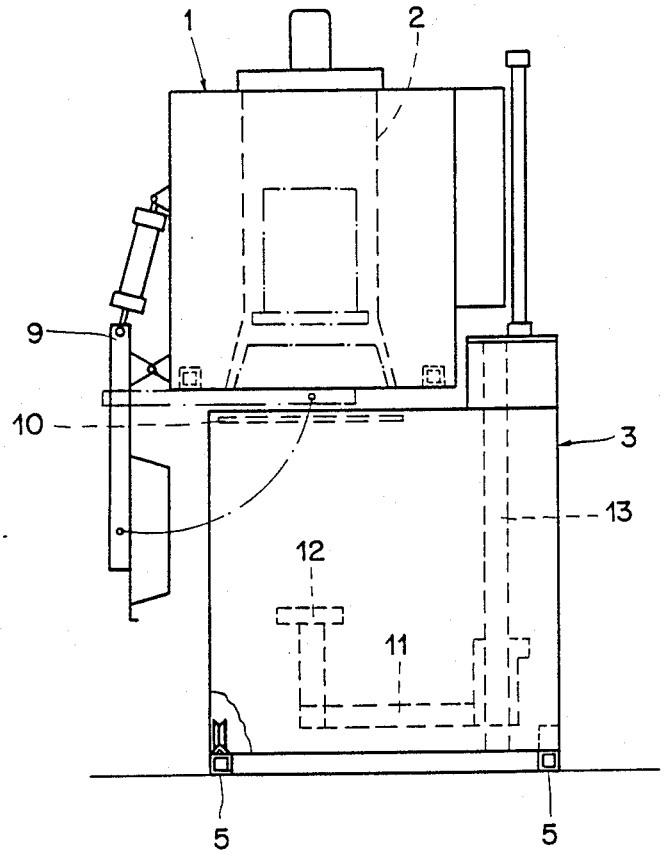

In FIG. 2, the charge 4 is within the bell 2 of the furnace 1, with a view to being brought thereto the required temperature. The furnace, at the time of the heating operation, is now closed by means of the closure device 9. The conveyor car has given way to a hardening vat 3, likewise movable horizontally relative to the furnace and displaceable on the conveyor track 5 after the closure device 9 has been opened. The vat contains a liquid hardening bath, e.g., oil, or a gaseous one, and, as the cases may be, a protective gas, e.g., nitrogen, protecting the oil against oxidation. This protective gas is conveyed into the vat by means of non-depicted conduits. The vat is closed at the top by a cover 10 in order to prevent any escape of treatment or protective gas. It further comprises a lift 11 provided with a platform 12 and capable of entering the bell, by sliding along a guide column 13, in order to convey the charge 4 into the vat for the hardening operations.

Figure 3:
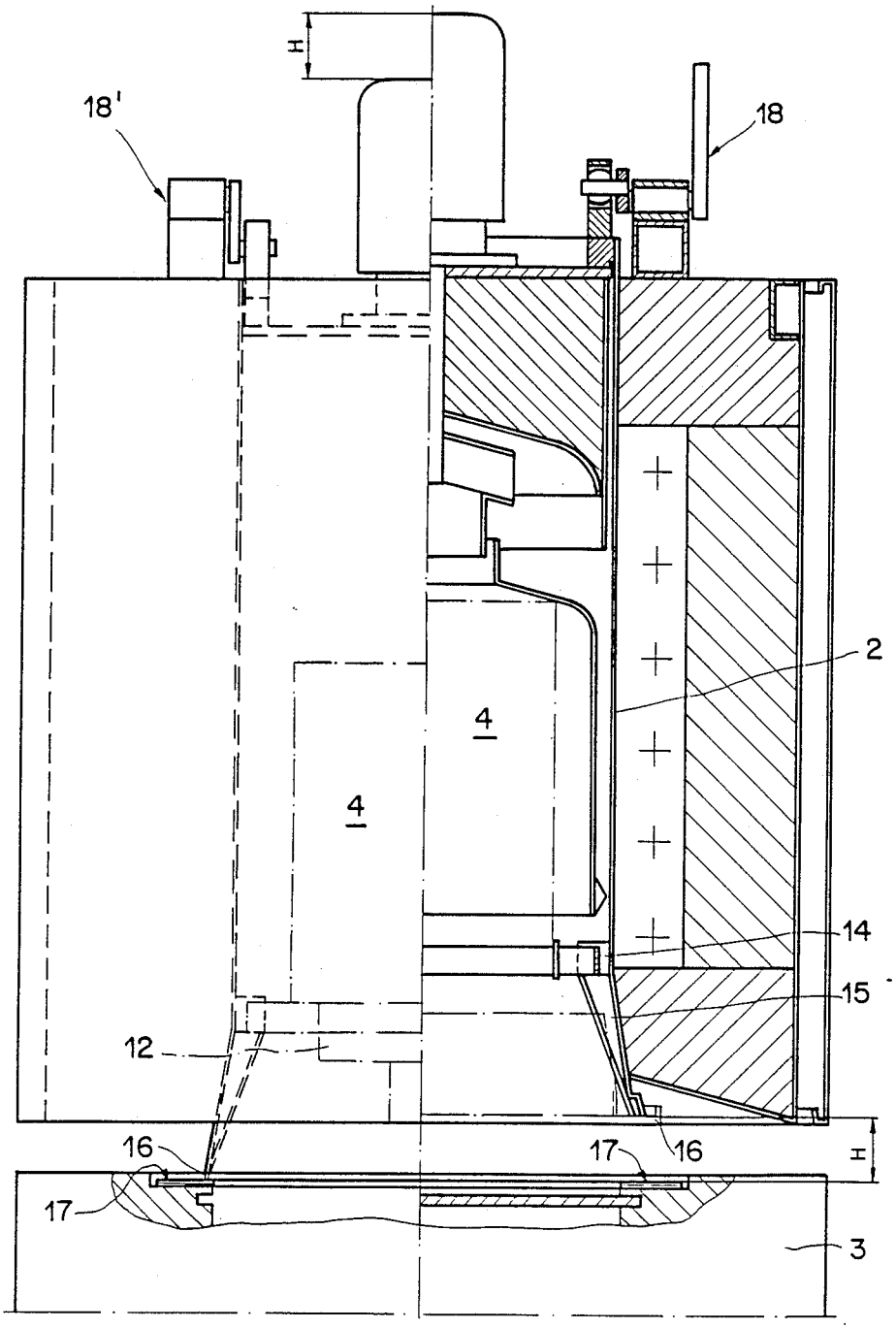
FIG. 3 is a profile view in partial section of the furnace showing the bell in high position and in low position.

FIG. 3 is a partial sectional view of the furnace, the bell being depicted in high position to the right of the longitudinal axis of the furnace and in low position to the left of that axis. The charge rests upon supporting means 14 fixed on reinforcing uprights 15, the supporting/reinforcing unit being integral with the bell 2 and porjecting from the sidewall. In the low position, to the left of the longitudinal axis, the bottom rim 16 of the bell 2 is brought against the top peripheral portion 17 of the vat 3, the bell and the vat then forming a tight enclosure. The process of obtaining the impreviousness and the manner of releasing the charge will be made clearer further on.

The bell is brought from the high position to the low position and vice versa owing to two crank/crank-handle devices 18, 18' fixed diametrically opposite one another on the top of the furnace. This device imparts to the bell a vertical movement and, at the same time, a rotational movement.

Figure 4A:
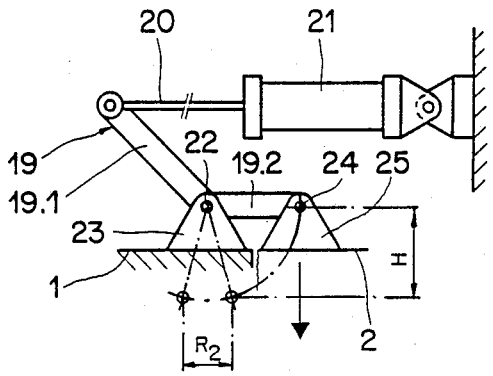
FIG. 4*a* depicts the device for actuating the vertical and rotational movement of the bell.
Figure 4B:
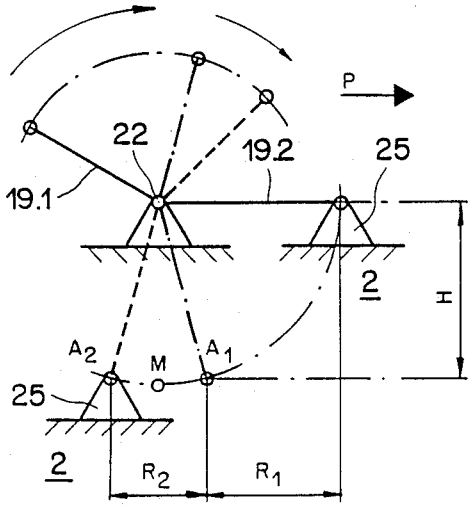
FIG. 4*b* is a diagram setting forth the vertical and rotational paths of the bell.
Figure 5:
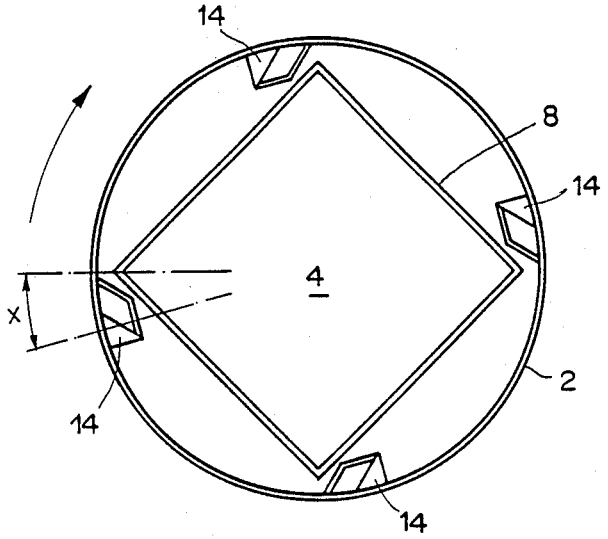
FIGS. 5 and 6 are top plan views showing an embodiment of the charge-supporting means in active position and in withdrawn position, respectively.
Figure 6:
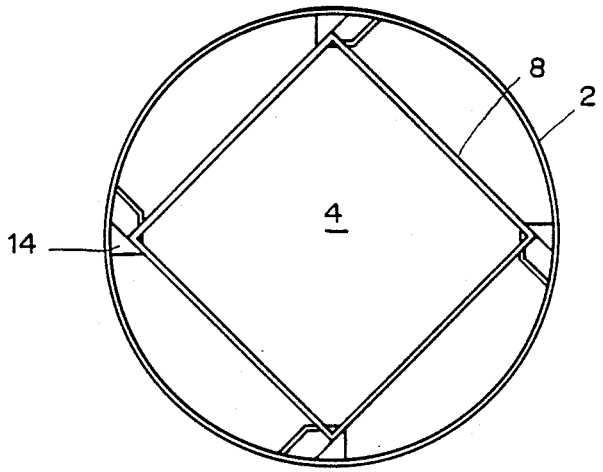

The principle of the mechanism will be described with the aid of FIGS. 4*a*, 4*b*, 5, and 6. Seen in FIG. 4*a* is a bent lever 19 forming two portions 19.1 and 19.2, and one of the ends of which is hinged on the end of a piston 20 actuated by a jack 21. The lever is hinged at the bent location about a shaft 22 mounted on a bearing 23 fixed on the furnace. The other end of the lever 19, i.e., the portion 19.2, is hinged about a shaft 24 mounted on a bearing 25 fixed on the bell 2, this bearing 25/bell 2 assembly in its entirety constituting a movable "suspended" unit. In FIG. 4*a*, the bell is placed in the high position, and the charge-supporting-frame 8, square in the example, rests on the supporting means 14 (FIG. 6). The movement of the bell is depicted diagrammatically in FIG.4*b*. Starting from the high position, the arm pivots about the shaft 22 under the influence of the jack and imparts to the bell a vertical movement of amplitude H, which, in the example, is on the order of 100 mm, and a rotation of amplitude $R_1$. The bell, at the point $A_1$, is in low position, and its bottom rim 16 is already in contact with the top peripheral portion 17 of the vat 3. The charge has accompanied this movement and remains, at this stage, on the supporting means 14, as depictedin FIG. 6. Starting from the point $A_1$, the supplementary action of the jack on the lever imparts to the bell a supplementary rotatio $R_2$, the bell then arriving at the point $A_2$. The vertical movement, in this path, is vritually equal to zero. It is in the interval $A_1$ to $A_2$ that, on the one hand, the release of the charge takes place (FIG. 6) and that, on the other hand, an ideal impreviousness will be achieved by pressure of the rim 16 of the bell on the rim 17 of the vat, the maximum pressure being exerted at the point M.

That be set forth, it is possible to enumerate the various sequences in order to make the mode of operation of the arrangement well understood, points 1 to 5 concerning the loading of the charge in the bell furnace, points 6 to 10 concerning the unloading:

1. The furnace is empty, the closure device is open, and the bell 2 is in the high position or initial position, while the charge 4 is conveyed by the materials handling car 6 under the furnace, in such a way that the longitudinal axis of the charge and the longitudinal axis of the bell coincide.

2. The crank/crank-handle device is actuated, the bell undergoing a movement of descent H and of rotation $R_1+R_2$ in order to occupy the low position. In this position, the supporting means 14 are in a withdrawn position, so that they release the perimeter of the charge (FIG. 5). The frame 8 of the cage may thus be displaced vertically in the furnace by means of the lift 11 to a height such that the base of the cage arrives just above the horizontal plane formed by the supporting means 14.

3. The charge is engaged by the reverse rotational movement $R_2$ (active position of supporting means 14, FIG. 6).

4. The lift has re-descended, and the bell is advanced into the high position, according to the movements $R_1$ and H.

5. The closure device 9 is closed, and the heating operation may begin.

6. When the heating operation is finished, the furnace is opened, and the hardening vat 3, closed by the cover 10, containing, for example, an oil bath and a protective gas, e.g., nitrogen, is brought below the furnace.

7. The crank/crank-handle devicee 18, 18' is actuated for placing the bell in low position at the point $A_1$ (movement $H+R_1$), in such a way that the bottom rim 16 of the bell is brought against the top peripheral portion 17 of the vat. The closure cover 10 of the vat is then withdrawn.

8. The platform 12 of the lift 11 is borne against the frame 8 of the cage which is still resting on the supporting means 14. The rotation R2 releases the carge, the supporting means 14 move into withdrawn position (FIG. 5) and perfects the imperviousness by metal-to-metal friction.

9. The lift 11 bearing the charge can descend freely to plunge the said charge into the oil of hardening vat, after which the cover 10 is reclosed.

10. The hardening vat is removed, and a new treatment cycle may be started.

It is clear that the sequences of the operations described above may be entirely programmed and controlled from a central control desk.

Figure 7:
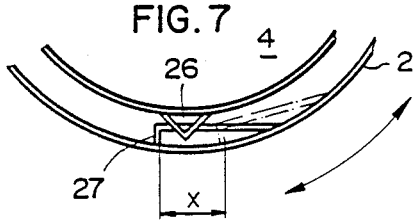
FIG. 7 is a partial top plan view presenting a second embodiment of the arrangement.

In the example just described, the cross-section of the cage, hence of the cage-support frame 8, is square, and four supporting means 14 are provided for. It is clear that a cage-support frame of round cross-section may just as well be utilized, the support frame being provided with at least three feet 26, capable of being placed on at least three supporting means 27 integral with the bell 2. As shown in FIG. 7.

Figure 8:
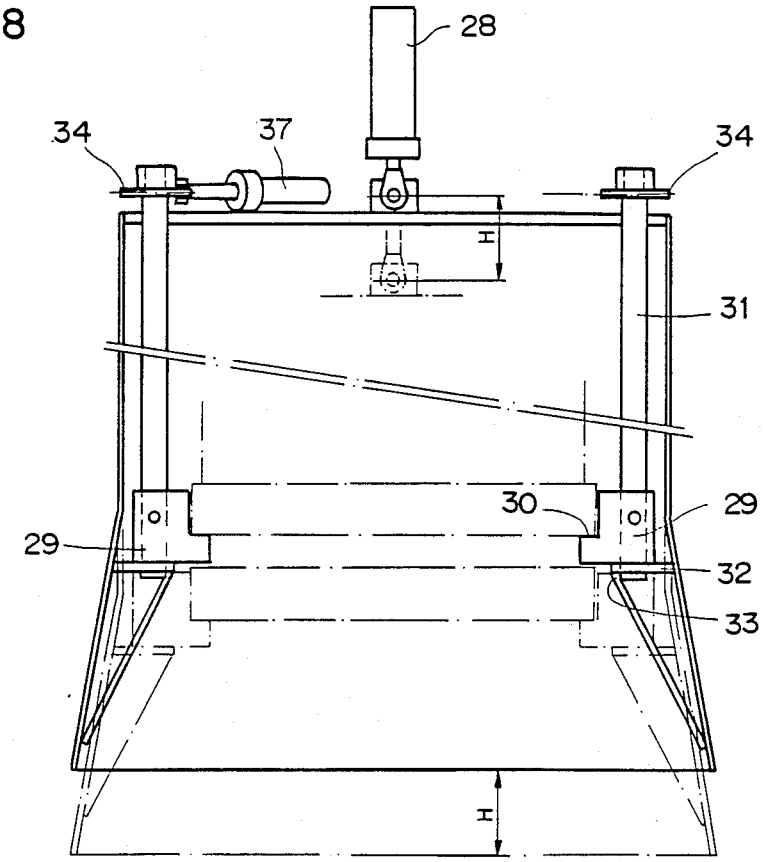
FIGS. 8 and 9 are profile and top plan views of the bell presenting a third embodiment of the arrangement.
Figure 9:
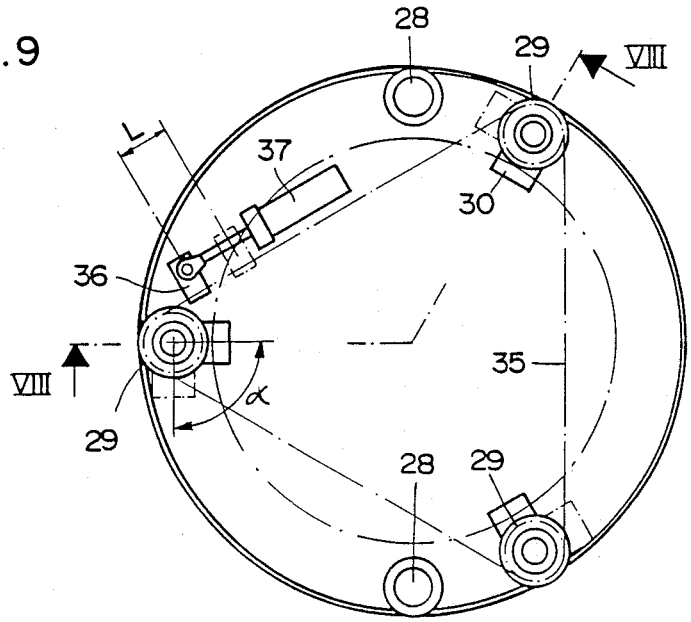
Figure 10:
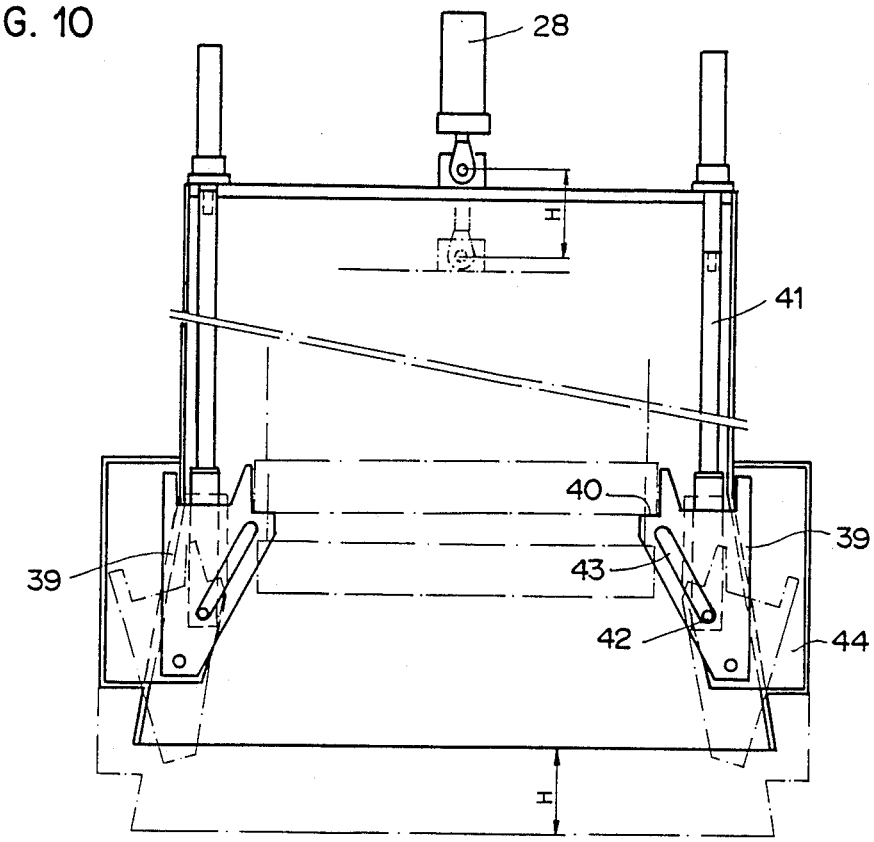
FIGS. 10 and 11 are profile and top plan views of the bell presenting a fourth embodiment of the arrangement.
Figure 11:
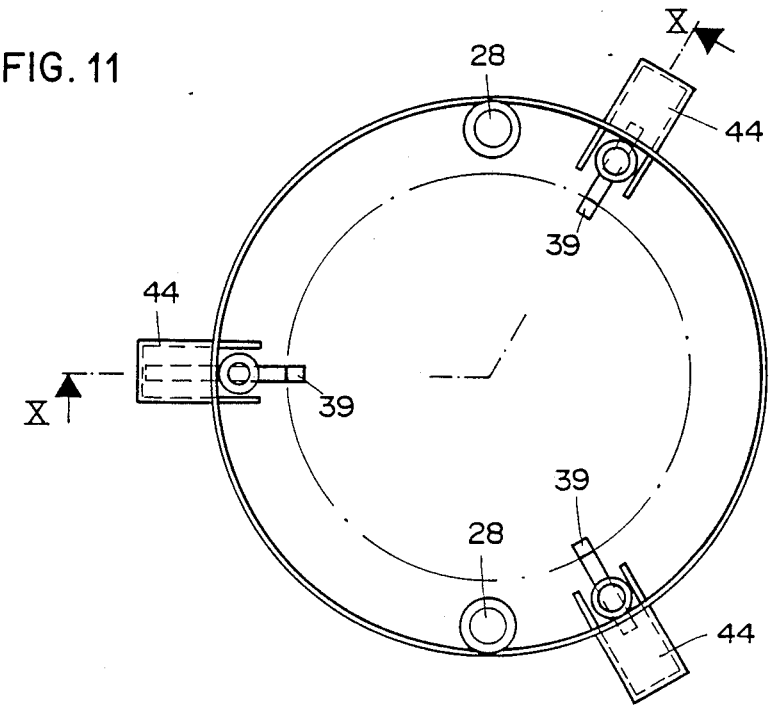

Two other interesting embodiments of the arrangement will further be described, referring to FIGS. 8 and 9, on the one hand, and to FIGS. 10 and 11 on the other hand.

The common particularity of these two embodiments consists in the fact that the bell is subjected solely to a vertical movement of amplitude H. This movement is imparted to the bell by means of two jacks 28.

In the embodiment depicted in FIGS. 8 and 9, the supporting means are composed of at least three angle-blocks having a horizontal flat surface 30 and are freely rotatable about a vertical axis, this freedom of rotation being limited to an angle $\alpha$, in such a way that the supporting means of the charge fitted in the bell 2 are encompassed of at least three angle-blocks 29, each angle-block being freely rotatable about a vertical axis, this freedom of rotation being limited to an angle $\alpha$ in such a way that the said angle-blocks can, simultaneously, be brought from an active position toward a withdrawn position and vice versa, the axis of each flat surface being, in the active position, oriented toward the center of the furnace and perpendicular to the vertical axis of the latter.

The simultaneous rotaton by the angle-blocks of $\alpha$ each time in the same positive or negative direction, is achieved each time by a rod 31, the bottom of which pivots in a bore 32 provided in a support-plate 33 fixed to the bell 2 of the furnace, and the top of which emerges from the top plate of the furnace 1 and is provided with a sprocket wheel 34, the angle-block 29, placed directly above the support-plate 33, being integral with the rod 31, and in that the sprocket wheels are connected to one another by a chain 35, itself held in a drum-head 36 fixed to the end of a jack 37, itself mounted on the top of the furnace and having its axis parallel to a length of chain 38 connecting two adjacent sprocket wheels, the actuating of the jack subjecting the chain to a straight-line movement of amplitude L in one direction or the other, this reciprocating straight-line movement being converted, via the sprocket wheels, into reciprocating rotary movement of the angle-blocks of angle $\alpha$.

In the example described, the angle $\alpha$ is placed to 90°.

In the embodiment represented by FIGS. 10 and 11, the supporting means are composed of at least three pawls 39, each provided with a horizontal flat surface 40, the pawls being capable of rocking simultaneously about axes which are horizontal and oriented tangentially relative to the bell from an active position toward a withdrawal position and vice versa.

The simultaneous rocking of the pawls from one position toward another is carried out by means of jacks 41, the rods of which are each joined to the corresponding pawl by sliding joints 42, 43.

The bell has, at the location of each pawl, a clearance cage 44 so as to permit the pawl to rock from the active position to the withdrawal position.

The bell furnace and hardening vat arrangement which is the subject of the present invention perfectly satisifes the objective aimed at: it permits a tight junction between the bell and the vat and a feed of protection gas. The quality of the hardened parts is thus considerably improved, the gas is not dispersed, whence a saving thereof. In addition, at the time of hardening, any emission of particles or of solid and/or liqid and/or gaseous elements into the surrounding atmosphere is avoided. In the same way any loss of energy is removed.

Finally, the arrangement answers the requirements of flexibility and rapidity, with a minimum space requirement, the result of which is a notable reduction of the cost-price of the heat treatment operations.

We claim:

1. A bell furnace and hardening vat arrangement, said furnace and said vat being placed at different levels, at least one of these elements being movable horizontally relative to the other, the arrangement including supporting means for supporting a charge composed of parts cntained in a cage, these means being integral with the bell and projecting from the sidewall and on the inside of the latter, the arrangement further comprising a lift capable of entering the bell, characterized in that vertical movement means are provided for subjecting the bell to a relative vertical movement in relation to the furnace, the furnace remaining fixed, while the vat is under the furnace, so that the bottom rim of the bell is brought against the top peripheral portion of the vat, the bell and the vat then forming a tight enclosure.

2. An arrangement according to claim 1, characterized in that operating means for operating the furnace permit in the same release of the charge by moving said supporting means between an active position where they extend under the perimeter of the charge and a withdrawn position where they release the perimeter of the charge and permit vertical displacement of said charge by means of the lift.

3. An arrangement according to claim 2, characterized in that the bell can be subjected, in addition to the vertical movement, to a movement of releasing the charge.

4. An arrangement according to claim 3, characterized in that the operating means is made up of two crank/crank-handle devices, fixed diametrically opposite to one another on the top of the furnace.

5. An arrangement according to claim 4, characterized in that the bell has four said supporting means and a cross-sectionof a support frame of said cage is of a generally square shape.

6. An arrangement according to claim 4, characterized in that the bell has at least three supporting means and a cross-section of a support frame of said cage is round, the support frame being provided with the same number of feet as there are supporting means, which feet rest on said supporting means when the latter occupy in active position.

7. An arrangement according to claim 1, characterized in that said supporting means comprise at least three angle-blocks actuated by means distinct from said vertical movement means permitting the release of the charge.

8. An arrangement according to claim 7, characterized in that each angle-block comprises a flat surface and is rotatable about a vertical axis, this rotation being limited to an angle $\alpha$ in such a way that said angle-blocks can simultaneously be brought from an active position toward a withdrawn position and vice versa, an axis of each flat surface being, in active position, oriented toward the center of the furnace and perpendicular to the vertical axis of the latter.

9. An arrangement according to claim 8, characterized in that the means for actuating the angle-blocks ciomprises a rod, the bottom of which pivots in a bore provided in a support-plate fixed to the bell of the furnace, and the top of which emerges from a top plate of the furnace and is provided with a sprocket wheel, the angle-blocks, placed directly above the support-plate, being integral with the rod, and in that the sprocket wheels are connected to one another by a chain, said chain being held in a drum-head fixed to the end of a jack mounted on the top of the furnace and having its axis parallel to a length of said chain connecting two adjacent sprocket wheels, the actuating of the jack subjecting the chain to a straight-line movement of amplitude L in one direction or the other, this reciprocating straight-line movement being converted, via the sprocket wheels, into reciprocating roatary movement of the angle-blocks by angle $\alpha$.

10. An arrangement according to claim 1, characterized in that that the supporting means are made up of at least three pawls (39), each provided with a horizontal flat (40), the pawls being able to rock simultaneously about axes which are horizontal and oriented tangentially relative to the bell, from an active position toward a withdrawn position and vice versa.

11. An arrangement according to claim 10, characterized in that the simultaneous rocking of the pawls from one position toward another is carried out by means of jacks (41), the rods of which are each connected to the corresponding pawl by sliding joints (42, 43).

12. An arrangement according to *, characterized in that the hardening vat (3) is provided with a cover (10) and with a feed of protective gas circulating between the solution contained in the vat and the cover.

* * * * *

UNITED STATES PATENT AND TRADEMARK OFFICE

CERTIFICATE OF CORRECTION

PATENT NO. : 4,858,893

DATED : August 22, 1989

INVENTOR(S) : Pierre BEURET et al

It is certified that error appears in the above-identified patent and that said Letters Patent is hereby corrected as shown below:

On the title page:

IN THE TITLE:

"FURNANCE" should read --FURNACE--;

IN THE ABSTRACT:

Line 4, after "comprises" insert --operating--;

Line 10, after "introduce" insert --a charge--.

Col. 1, line 19, delete "of" (second occurrence only).

Col. 2, line 66, delete "The";

line 67, change "when" to --the--.

Col. 3, line 2, change "thereto" to --there to--;

line 25, change "porjecting" to --projecting--;

line 29, change "impreviousness" to --imperviousness--;

line 61, change "depictedin" to --depicted in--;

line 63, change "rotatio" to --rotation--;

line 65, change "vritually" to --virtually--;

line 67, change "impreviousness" to --imperviousness--.

Col. 4, line 3, change "be" to --being--;

line 36, change "devicee" to --device--;

line 45, change "carge" to --charge--;

line 50, after "of" insert --the--;

UNITED STATES PATENT AND TRADEMARK OFFICE

CERTIFICATE OF CORRECTION

PATENT NO. : 4,858,893

DATED : August 22, 1989

INVENTOR(S) : Pierre BEURET et al

It is certified that error appears in the above-identified patent and that said Letters Patent is hereby corrected as shown below:

line 64, change ".As" to --,as--.

Col. 5, lines 10-11, change "encompassed" to --composed--;

line 39, change "placed" to --equal--;

line 56, change "satisifes" to --satisfies--;

line 61, change "liqid" to --liquid--.

IN THE CLAIMS:

Claim 1, col. 6, line 6, change "cntained" to --contained--.

Claim 2, col. 6, line 18, change "in the same" to --the--.

Claim 5, col. 6, line 34, change "cross-sectionof" to --cross-section of--.

Claim 6, col. 6, line 41, change "in" to --an--.

Claim 9, col. 6, line 59, change "ciomprises" to --comprises--.

Claim 10, col. 7, line 8, delete "that" (second occurrence only);

line 9, delete "(39)"; after "each" insert --pawl--;

line 10, after "flat" insert --surface--, and delete "(40)".

Claim 11, col. 8, line 6, delete "(41)";

line 7, delete "(42, 43)".

Claim 12, col. 8, line 8, change "*" to --claim 1--;

line 9, delete "(3)" and "(10)";

Signed and Sealed this

Twenty-second Day of January, 1991

*Attest:*

HARRY F. MANBECK, JR.

*Attesting Officer* *Commissioner of Patents and Trademarks*